US010667336B2

(12) United States Patent
Miyajima et al.

(10) Patent No.: US 10,667,336 B2
(45) Date of Patent: May 26, 2020

(54) FOOD COOKING SYSTEM

(71) Applicants: NISSHIN SEIFUN GROUP INC., Tokyo (JP); PANASONIC CORPORATION, Osaka (JP)

(72) Inventors: Takaaki Miyajima, Saitama (JP); Kentaro Irie, Saitama (JP); Toshiyuki Miyazaki, Saitama (JP); Yumiko Nakanishi, Saitama (JP); Akira Kataoka, Osaka (JP); Masaki Shibuya, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 299 days.

(21) Appl. No.: 15/563,835

(22) PCT Filed: Feb. 9, 2016

(86) PCT No.: PCT/JP2016/053763
§ 371 (c)(1),
(2) Date: Oct. 2, 2017

(87) PCT Pub. No.: WO2016/163146
PCT Pub. Date: Oct. 13, 2016

(65) Prior Publication Data

US 2018/0098391 A1 Apr. 5, 2018

(30) Foreign Application Priority Data

Apr. 6, 2015 (JP) ..... 2015-077865

(51) Int. Cl.
*H05B 1/02* (2006.01)
*H05B 6/64* (2006.01)
(Continued)

(52) U.S. Cl.
CPC ..... *H05B 6/6479* (2013.01); *B65D 81/3453* (2013.01); *F24C 7/02* (2013.01); *H05B 6/6408* (2013.01); *B65D 2205/02* (2013.01)

(58) Field of Classification Search
CPC ..... H05B 6/6479; B65D 81/3453; B56D 2205/02
(Continued)

(56) References Cited

U.S. PATENT DOCUMENTS 4,961,944 A 10/1990 Matoba et al.
6,229,131 B1 * 5/2001 Koochaki ..... H05B 6/6494 219/730
(Continued)

FOREIGN PATENT DOCUMENTS

CN 1525928 A 9/2004
EP 0245005 A2 11/1987
(Continued)

OTHER PUBLICATIONS

Extended European Search Report in Europe Application No. 16776315.0, dated Nov. 27, 2018, pp. 1-9.
(Continued)

*Primary Examiner* — Mark H Paschall
(74) *Attorney, Agent, or Firm* — Brinks Gilson & Lione

(57) ABSTRACT

A food cooking system (1A) of the present invention includes: a single-serving food package (19) including food (F) and an accommodating body (10) that accommodates the food (F); a heating chamber (2); a steam supplier (3); and a microwave supplier (4); and heats and cooks the food (F) in the single-serving food package (19) with steam and microwaves. The accommodating body (10) has a wall portion that defines an accommodating space for the food (F). The wall portion includes a bottom surface portion (11) on which the food (F) is placed and a peripheral surface portion (12),
(Continued)

and vent holes (15) for steam to pass through are formed in the wall portion. Steam at a temperature of 85 to 130° C. is supplied into the heating chamber (2) by the steam supplier (3), and microwaves with an actual output of 500 to 3000 W are supplied for 15 to 180 seconds by the microwave supplier (4) while the steam is supplied into the accommodating body (10) via the vent holes (15).

3 Claims, 6 Drawing Sheets

(51) Int. Cl.
*F24C 7/02* (2006.01)
*B65D 81/34* (2006.01)

(58) Field of Classification Search
USPC ..... 99/330; 219/680, 682, 702, 731, 762
See application file for complete search history.

(56) References Cited

U.S. PATENT DOCUMENTS

| | | | | |
|---|---|---|---|---|
| 10,104,722 | B2 * | 10/2018 | Ueki | F24C 15/006 |
| 2004/0169037 | A1 | 9/2004 | Roussel et al. | |
| 2005/0079250 | A1 | 4/2005 | Mao et al. | |
| 2006/0088301 | A1 * | 4/2006 | Kanzaki | F24C 15/327 392/386 |
| 2007/0221070 | A1 | 9/2007 | Akashi et al. | |
| 2012/0097668 | A1 | 4/2012 | McGuiness et al. | |
| 2019/0283952 | A1 * | 9/2019 | Pawlick | B65D 81/343 |

FOREIGN PATENT DOCUMENTS

| | | | |
|---|---|---|---|
| EP | 0856704 | A1 | 8/1998 |
| JP | S53-13955 | U | 2/1978 |
| JP | H05-276884 | A | 10/1993 |
| JP | H08-128645 | A | 5/1996 |
| JP | 2003192074 | A | 7/2003 |
| JP | 2004-239465 | A | 8/2004 |
| JP | 2005-082197 | A | 3/2005 |
| JP | 2005-257120 | A | 9/2005 |
| JP | 2005-308312 | A | 11/2005 |
| JP | 2007-271104 | A | 10/2007 |
| JP | 2011-237144 | A | 11/2011 |
| JP | 2011-241987 | A | 12/2011 |
| JP | 2012-075586 | A | 4/2012 |
| JP | 2013-120018 | A | 6/2013 |
| JP | 2013-215139 | A | 10/2013 |
| JP | 2014-25612 | A | 2/2014 |
| JP | 2014-032683 | A | 2/2014 |

OTHER PUBLICATIONS

News Release, and English language translation thereof, "Lawson-Established the First 'Lawson Farm Ibaraki' in Kita Kanto", *Lawson ID*, Mar. 18, 2014, Retrieved from the internet at http://www.lawson.co.jp/company/news/detail/1247088_2504.html, 5 pages.

International Search Report, and English language translation thereof, in corresponding International Application No. PCT/JP2016/053763, dated May 17, 2016, 5 pages.

* cited by examiner

FOOD COOKING SYSTEM

This application is a 371 application of PCT/JP2016/053763 having an international filing date of Feb. 9, 2016, which claims priority to JP2015-077865 filed Apr. 6, 2015, the entire contents of which are incorporated herein by reference.

TECHNICAL FIELD

The present invention relates to a food cooking system for heating food with steam and microwaves.

BACKGROUND ART

To reheat frozen food so as to make it edible, there can be used a defrosting method such as defrosting frozen food by heating it over an open fire, defrosting frozen food by heating a vessel containing the frozen food in hot water, or defrosting frozen food by heating it in a microwave oven. Of these defrosting methods, microwave ovens make it possible to defrost frozen food easily and hygienically without making hands dirty, and are therefore generally widespread. Most of conventional microwave ovens have only so-called "warming" function or "microwave cooking" function of performing high-frequency heating of food, which is an object to be heated, by irradiating the food with microwaves. However, recently, with the diversification of food and the like, microwave ovens have become more and more multi-functional, and microwave ovens of a type having, in addition to the cooking functions using high-frequency heating, a so-called "steam cooking" function using steam heating are widely used (see Patent Literatures 1 and 2). While high-frequency heating has the advantage of short heating time, it has the disadvantages of being likely to result in uneven heating and also being likely to cause drying and hardening of the food if heated excessively. On the other hand, in steam heating, food is heated with steam generated by boiling water, and therefore, the disadvantages of high-frequency heating can be compensated for by combining high-frequency heating with steam heating.

Patent Literatures 3 to 5 disclose techniques for improving heating cookers having a microwave cooking function and a steam cooking function. In these techniques, a container accommodating food to be heated, is disposed in a heating chamber of a heating cooker, and the container is provided with an inlet port for steam supplied from a steam supplier, so that steam can be directly introduced into the container. A container (steam cooker) with a lid disclosed in Patent Literature 3 is configured such that an internal space of the container is partitioned into two, an upper and lower space, by a steam-permeable partition plate. In this container, food is accommodated in the upper space, and a steam inlet port is provided in a wall portion defining the lower space, so that steam can be directly introduced into the lower space. Containers disclosed in Patent Literatures 4 and 5 have a receiving tray on which food is to be placed and a grill tray lid that covers the receiving tray, the grill tray lid being provided with a steam inlet port. According to Patent Literatures 3 to 5, the techniques disclosed therein purport to enable food to be deliciously cooked while increasing cooking efficiency and reducing cooking time.

Patent Literature 6 discloses a technique that uses steam heating to defrost frozen food (pasta containing rice flour). The technique disclosed in Patent Literature 6 was made in view of the following problem: compared with ordinary pasta made from only wheat flour, pasta containing rice flour significantly deteriorates in quality when defrosted from a frozen state. The technique includes a step of keeping frozen pasta that contains rice flour and has been boiled and frozen under specific conditions, in steam at gauge pressure within a specific range for a specific period of time to thereby quickly defrost the frozen pasta. According to Patent Literature 6, the technique disclosed therein purports to make it possible to perform integrated management of the steps of boiling and freezing in a processing factory, the step of transporting from the processing factory to a store, and the steps of storing and quickly defrosting in the store, and to provide chewy pasta containing rice flour in a short period of time upon receiving an order.

CITATION LIST

Patent Literatures

Patent Literature 1: JP 2013-120018A
Patent Literature 2: JP 2014-25612A
Patent Literature 3: JP 2007-271104A
Patent Literature 4: JP 2011-237144A
Patent Literature 5: JP 2011-241987A
Patent Literature 6: JP 2013-215139A

SUMMARY OF INVENTION

Technical Problem

Conventional heating cookers such as those disclosed in Patent Literatures 1 to 5 meet the demand for increasing cooking efficiency and reducing cooking time and can provide high-quality ready-cooked food. However, against the background of the diversification of lifestyles, the diversification of food, and the like, the required level has been on the rise recently, and therefore, food cooking systems with higher performance are in demand. Moreover, for example, the containers, such as the receiving tray and the steam cooker, of the heating cookers disclosed in Patent Literatures 3 to 5 are basically dedicated for cooking. Thus, prior to cooking food, there is required an operation of taking out the food, which is an object to be cooked, from its packaging container and transferring it to such a container dedicated for cooking. Moreover, after cooking the food using the container dedicated for cooking, there is also required an operation of transferring the cooked food accommodated in the container dedicated for cooking to a piece of tableware (a dish or the like) for eating and serving. These operations take extra time and effort, and due to these operations, the food may be touched by hands, cooking utensils, and the like prior to cooking, during cooking, and after cooking until the food is eaten. For this reason, there is room for improvement from a hygiene standpoint as well. For heating cookers that use steam and microwaves, a technique that can sufficiently meet the need for heating and cooking food to be cooked together with its accommodating body has not yet been provided.

The problem to be addressed by the present invention relates to providing a food cooking system that makes it possible to easily heat and cook food, such as frozen food, together with its accommodating body by means of steam and microwaves, to collectively and hygienically handle the heated and cooked food and the accommodating body as a single-serving food package after heating and cooking, and furthermore, to obtain the heated and cooked food in a high-quality finished state.

Solution to Problem

The invention provides a food cooking system comprising: a single-serving food package including food as an object to be cooked and an accommodating body accommodating the food; a heating chamber accommodating the single-serving food package; a steam supplier that supplies steam into the heating chamber; and a microwave supplier that supplies microwaves into the heating chamber, the food cooking system heating and cooking the food with the steam and the microwaves, wherein the accommodating body is configured to be able to take in steam that is in the heating chamber into the single-serving food package, and steam at a temperature of 85 to 130° C. is supplied into the heating chamber by the steam supplier, and microwaves with an actual output of 500 to 3000 W are supplied by the microwave supplier for 15 to 180 seconds while the steam is supplied into the single-serving food package.

Advantageous Effects of Invention

According to a food cooking system of the present invention, it is possible to easily heat and cook food, such as frozen food, together with its accommodating body by means of steam and microwaves, to collectively and hygienically handle the heated and cooked food and the accommodating body as a single-serving food package after heating and cooking, and furthermore, to obtain the heated and cooked food in a high-quality finished state. The "high-quality finished state" as used herein specifically means, for example, that with respect to food obtained by heating and cooking frozen food, excessive heating and drying, which are peculiar to microwave ovens, are prevented, the finished food has a wet feel, and the same taste, texture, and appearance as those immediately after being cooked before being frozen are achieved. Moreover, the accommodating body constituting the single-serving food package is essentially a disposable accommodating body designed for an accommodated object (food) that is to be completely consumed in a single sitting. Thus, after the food in the single-serving food package has been eaten, the accommodating body can be disposed of, so that a series of operations from cooking to clean-up after eating can be performed easily and hygienically.

DESCRIPTION OF EMBODIMENTS

Figure 1:
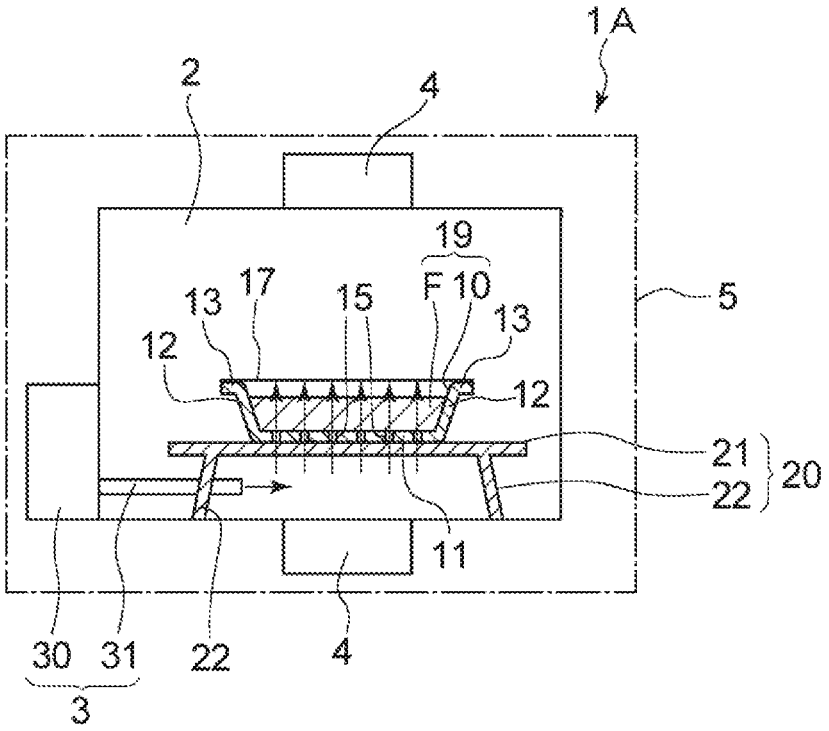
FIG. 1 is a schematic front view of an example of a heating cooker as an embodiment of a food cooking system of the present invention.

Hereinafter, the present invention will be described based on preferred embodiments thereof with reference to the drawings. FIG. 1 schematically shows the configuration of a heating cooker 1A as an embodiment of a food cooking system of the present invention. The heating cooker 1A is a type of food cooking system for heating food F, which is an object to be heated, with steam (water vapor) and microwaves. The heating cooker 1A includes: a single-serving food package 19 including the food F and an accommodating body 10 accommodating the food F; a heating chamber 2 that accommodates the single-serving food package 19; a steam supplier 3 that supplies steam into the heating chamber 2; and microwave supplier 4 that supply microwaves into the heating chamber 2.

More specifically, the heating cooker 1A includes a rectangular parallelepiped-shaped main body casing 5 that forms the exterior of the heating cooker 1A, and the heating chamber 2 having a rectangular shape in front view is disposed in the main body casing 5. A door (not shown) is attached to a front face of the main body casing 5, the door being rotatable about one side of the front face of the main body casing 5, the side serving as the axis of rotation. The heating chamber 2 is configured to be openable/closable by opening/closing the door. Moreover, although not shown, an operating panel constituted by a liquid crystal display panel, dials, buttons, and the like is provided on a lateral side of the door in the front face of the main body casing 5. It is possible to set, for example, the operating and heating conditions for the heating cooker 1A by operating the operating panel.

The steam supplier 3 includes a steam generator 30 and a steam supply pipe 31. The steam generator 30 includes a heater and the like for heating water into water vapor, and is provided, within the main body casing 5, on a lateral side of and adjacent to the heating chamber 2. When the heating cooker 1A is in operation, water that is needed to generate steam is supplied to the steam generator 30, and the supplied water is heated and boiled in the steam generator 30 to convert into water vapor (saturated water vapor). Water that is used to generate steam may be, for example, directly supplied from a faucet or may be supplied from a water tank (not shown) included in the heating cooker 1A through a feed pump (not shown). The water vapor (saturated water vapor) generated in the steam generator 30 is supplied into the heating chamber 2 via the steam supply pipe 31.

The microwave suppliers 4 are disposed, within the main body casing 5, on the upper and lower sides respectively of the heating chamber 3, and include a magnetron that generates microwaves, a waveguide that transmits the generated microwaves, a rotating antenna that radiates the microwaves into the heating chamber 3, and the like.

The heating cooker 1A has the same basic configuration as known microwave ovens having a so-called steam cooking function. The steam supplier 3 and the microwave supplier 4 of the heating cooker 1A can have the same configurations as those of the known microwave ovens. Furthermore, the heating cooker 1A includes various other means that are usually included in the known microwave ovens, for example, a temperature detecting means that detects the temperature of the heating chamber 2. Moreover, as is the case with known microwave ovens of this type having the steam cooking function, the heating cooker 1A is configured to be switchable between various cooking modes, and can perform not only a cooking mode in which both the steam heating through the steam supplier 3 and the high-frequency heating through the microwave supplier 4 are used, but also a cooking mode in which only one of the steam heating and the high-frequency heating is used.

The single-serving food package 19 includes the food F to be cooked and eaten and the accommodating body 10 in which the food F is accommodated and packaged, and is a package for commercial use. The single-serving food package 19 is in a form in which it can be marketed alone, and may be displayed in a store as is and pass into the hands of a general consumer. In a case where a general consumer purchases the single-serving food package 19 from a store, for example, the single-serving food package 19 purchased from the store can be stored in a refrigerator or a freezer as is, if needed. Then, when the single-serving food package 19 is to be served for eating, the single-serving food package 19 need only be placed in the heating chamber 2 of the heating cooker 1A as is and heated and cooked. That is, the cooked food F can be served and eaten in a state in which it remains accommodated in the accommodating body 10 without the need for transferring it to a separate eating and serving container such as a dish. The accommodating body 10 can also be disposed of after the food F has been eaten. Therefore, by using the single-serving food package 19, food can be easily and hygienically cooked, served, and eaten, and for example, cooking can be performed even in a section in a store such as one where a dedicated kitchen is not installed (e.g., around a cash desk in a supermarket).

The type of food F accommodated in the single-serving food package 19 is not limited, and examples thereof include noodles such as pasta, udon, soba, and Chinese noodles, cooked rice, bread, and steamed food. Also, the state of the food F is not limited, and the food F may be raw (unfrozen and unheated state) or may be in a refrigerated or frozen state. The heating cooker 1A can be used to heat raw food (unfrozen and unheated food), defrost frozen food, and warm chilled (refrigerated) food, for example, and is particularly effective in defrosting frozen noodles and defrosting and heating cooked rice.

The accommodating body 10 constituting the single-serving food package 19 is composed of a material that is capable of resisting heating in a microwave oven, specifically, resin or paper. The accommodating body 10 is configured to be able to take in steam that is in the heating chamber 2 into the single-serving food package 19. More specifically, the accommodating body 10 in the present embodiment has a wall portion that defines a space for accommodating food, which is denoted by reference symbol F in the drawings. The wall portion includes a bottom surface portion 11, on which the food F is placed, and a peripheral surface portion 12 extending upward from a peripheral edge of the bottom surface portion 11. A plurality of vent holes 15 for steam to pass through are formed in the wall portion, penetrating the wall portion in a thickness direction thereof. The accommodating body 10 is configured to be able to take in steam that is in the heating chamber 2 into the single-serving food package 19 via the plurality of vent holes 15. The peripheral surface portion 12 is constituted by four flat plate-like side wall portions extending upward from the four sides, respectively, of the bottom surface portion 11 having a rectangular shape in plan view. The inside surrounded by the bottom surface portion 11 and the peripheral surface portion 12 (four side wall portions) constitutes a space for accommodating the food to be heated.

The accommodating body 10 in the present embodiment is a tray having a substantially quadrangular shape in plan view, and has an upper opening through which the food can be placed therein and taken out. As shown in FIG. 1, the upper opening is covered by a lid portion 17 during subjecting the single-serving food package 19 to cooking. The lid portion 17 is removed when the food F in the single-serving food package 19 is to be eaten after subjecting the single-serving food package 19 to cooking. It is sufficient if the lid portion 17 is an openable member having steam-impermeability and is capable of separating the inside and the outside of the accommodating body 10 from each other. For example, a resin film such as a plastic wrap and a resin plate-like member such as a fitting lid engageable with an upper end portion (flange portion 13) of the peripheral surface portion 12 can be used.

In the accommodating body 10 of the present embodiment, the flange portion 13 is formed protruding from the upper end portion of the peripheral surface portion 12. The flange portion 13 protrudes from the upper end portion of the peripheral surface portion 12 outward in a horizontal plane direction (direction orthogonal to the depth direction of the accommodating body). When the accommodating body 10 is viewed from above, the flange portion 13 is continuous in such a manner as to surround the upper opening of the accommodating body 10. The flange portion 13 can be used as a finger grip by which the accommodating body 10 (single-serving food package 19) is held with fingers. Also, in other embodiments described later, the flange portion 13 can be used as an engagement site for the support member 6 that is used in subjecting the single-serving food package 19 to cooking (see FIG. 4). Moreover, in the case where a resin film such as a plastic wrap is used as the lid portion 17, the flange portion 13 functions as an adherent portion to which the film is allowed to adhere.

In the present embodiment, the plurality of vent holes 15 are formed in only the bottom surface portion 11 in a scattered manner, and no vent holes 15 are formed in the peripheral surface portion 12. The plurality of vent holes 15 have the same shape and dimensions in plan view. In the present invention, it is sufficient if the vent holes 15 are formed in a wall portion of the accommodating body 10 which wall portion defines the space for accommodating the food. Thus, the vent holes 15 may be formed in the peripheral surface portion 12 and may be formed in the lid portion 17 opposing the bottom surface portion 11. The vent holes 15 that are formed in the bottom surface portion 11, on which the food F is placed, not only function to allow steam to pass through but can also function as discharge holes for a liquid such as water and the like exuding from the food F. For this reason, it is preferable that the vent holes 15 be formed in at least the bottom surface portion 11.

In the accommodating body according to the present invention, the opening area and opening ratio of the vent holes for steam to pass through in the bottom surface portion can be adjusted as appropriate in accordance with the form of the accommodating body, and are not limited. However, in the case where the accommodating body is a tray like the accommodating body 10 shown in FIG. 1, the opening area of a single vent hole is preferably 6 to 80 $mm^2$, more preferably 12 to 65 $mm^2$, and even more preferably 15 to 55 $mm^2$, and the opening ratio of the bottom surface portion of the tray as the accommodating body is preferably 1 to 40%, more preferably 2 to 30%, and even more preferably 4 to 20%, in view of balance between heating efficiency in heating food with steam and the functions of the container. The "opening ratio" as used herein means the ratio of a total value of the opening areas of all the vent holes 15 formed in a site (e.g., bottom surface portion 11), with respect to which the opening ratio is to be obtained, to the total area of an external surface or an internal surface of the site. Note that in the case where vent holes 15 are formed in the peripheral surface portion 12 or the lid portion 17, the opening area and opening ratio of the vent holes 15 can be set in the same manner as those for the bottom surface portion 11.

Moreover, the accommodating body according to the present invention includes not only a tray such as that shown in the drawing but also a resin packaging bag for individual packaging of the food. In the case where the accommodating body is such a packaging bag, the opening area of a single vent hole is preferably 2 to 80 $mm^2$, more preferably 3 to 50 $mm^2$, and even more preferably 4 to 25 $mm^2$, and the opening ratio of the bottom surface portion of the packaging bag as the accommodating body is preferably 1 to 30%, more preferably 1 to 20%, and even more preferably 1 to 10%, from the same standpoint as that described above.

Figure 2A:
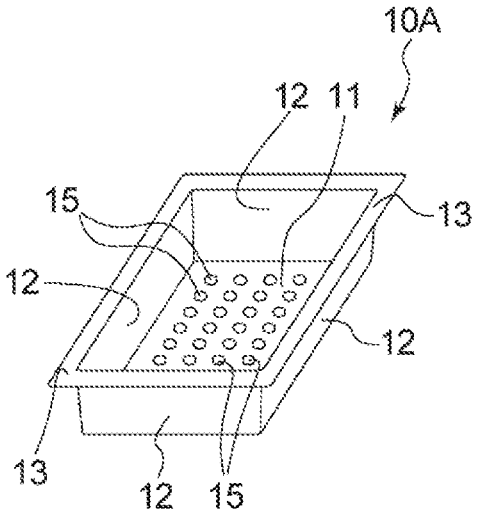
FIGS. 2A to 2C are perspective views each schematically showing an embodiment of an accommodating body of the heating cooker shown in FIG. 1.
Figure 2B:
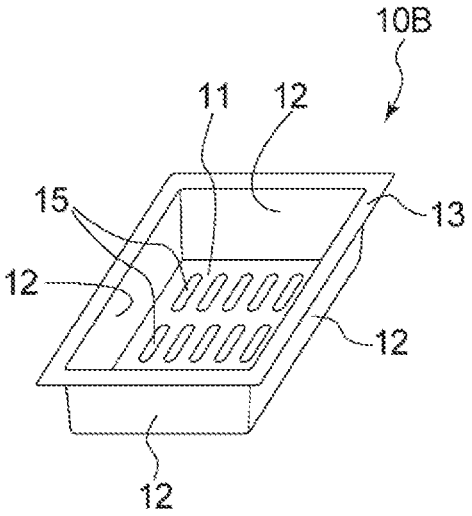

The longest portion of each of the plurality of vent holes 15 in the bottom surface portion 11 of the accommodating body 10 has a length of preferably not more than 50 mm and more preferably 3 to 30 mm at an opening end portion thereof located on the internal surface side of the accommodating body 10. The "longest portion of each vent hole 15" as used herein means the diameter or the like in the case where the vent holes 15 have an isotropic shape, such as a true circular shape shown in FIG. 2A, in plan view, and means the major axis or the like in the case where the vent holes 15 have an anisotropic shape, such as an oblong elliptical shape shown in FIG. 2B, in plan view. Moreover, the "longest portion of each vent hole 15" refers to the value that is measured at the opening end portion thereof located on the internal surface side (food accommodating space side) of the accommodating body 10. Each vent hole 15 in the present embodiment has a constant size in the thickness direction of a wall portion in which it is formed, and also the longest portion of each vent hole 15 on the internal surface side of the accommodating body 10 is the same as the longest portion on the external surface side.

Figure 2C:
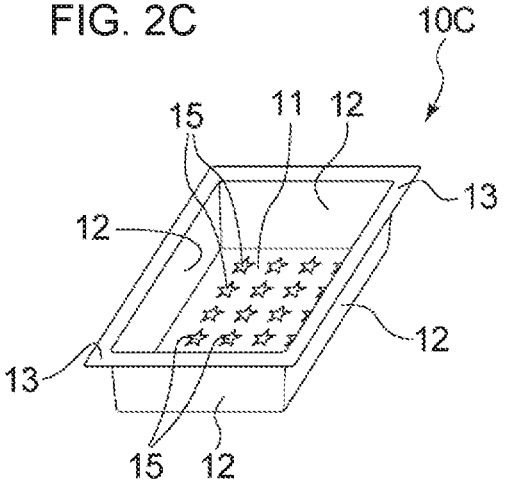

The shape of the vent holes 15 in plan view, the formation pattern thereof, and the like are not limited and can be set as appropriate. FIG. 2 shows variations 10A, 10B, and 10C of the accommodating body 10. Note that in view of facilitating the description, the lid portion 17 (see FIG. 1) is omitted from FIG. 2 and FIGS. 3(*b*), 4(*b*), and 5(*b*), which will be referred to later. All of the accommodating bodies 10A, 10B, and 10C shown in FIG. 2 have a plurality of vent holes 15 that are formed in the bottom surface portion 11 in a scattered manner, and can be used as the accommodating body 10 shown in FIG. 1. The accommodating bodies 10A, 10B, and 10C differ from one another in the shape of the vent holes 15 in plan view: the vent holes 15 of the accommodating body 10A shown in FIG. 2(*a*) have a true circular shape in plan view, the vent holes 15 of the accommodating body 10B shown in FIG. 2(*b*) have an oblong elliptical shape in plan view, and the vent holes 15 of the accommodating body 10C in FIG. 2(*c*) have a star shape in plan view. Note that although all the vent holes 15 have the same shape and dimensions in all of the forms shown in the drawings, the plurality of vent holes 15 of the present invention may also have different shapes and dimensions.

In the case where the vent holes 15 have a true circular shape in plan view, the diameter thereof is preferably 1 to 10 mm. In the case where the vent holes 15 have a shape elongated in one direction, such as an oblong elliptical shape or a rectangular shape, in plan view, the short side thereof has a length of preferably 1 to 10 mm, and the long side has a length of preferably 10 to 50 mm. Note that the dimensions related to the shape of the vent holes 15 in plan view herein mean the measured values on the opening end portion of each vent hole 15 that is located on the internal surface side (food-accommodating space side) of the accommodating body 10.

The shape of the accommodating body 10 is not limited to a quadrangular shape in plan view, such as that shown in the drawings, and a circular shape, an elliptical shape, and polygonal shapes other than the quadrangular shape can be employed. Also, the dimensions of various portions of the accommodating body 10 are not limited. However, according to the findings of the inventors of the present invention, it is particularly preferable that an accommodating body of a tray type, like the accommodating body 10, have a circular shape in plan view. In the case where an accommodating body of a tray type has a circular shape in plan view, the shape of the food in plan view becomes circular and hence has no corner portions, when food is packed into the accommodating body. Consequently, the disadvantage in that microwaves supplied during heating and cooking concentrate on the corner portions of the food is prevented, and there is an advantage in that the whole of the food is likely to be uniformly irradiated with microwaves. Moreover, an accommodating body of a tray type having a circular shape in plan view has another advantage in that steam is likely to be uniformly diffused on an opposite side of a mount table 20, which will be described later, to a surface (upper surface) thereof on which the single-serving food package 19 is placed. This advantage makes it easy for steam to be uniformly supplied to the entire single-serving food package 19.

Moreover, with consideration given to an improvement in the handleability of the single-serving food package 19, and the like, it is preferable that the accommodating body 10 constituting the single-serving food package 19 have a size that is just enough to accommodate an amount of food that can be completely eaten by a normal adult in one sitting. From this standpoint, for example, in the case where the space of the accommodating body 10 in which space the food is accommodated has a quadrangular shape in plan view as shown in FIG. 2, the length of one side of the space having the quadrangular shape in plan view is preferably 50 to 300 mm and more preferably 100 to 200 mm, and in the case where the above-described space has a circular shape, the diameter of the space having the circular shape in plan view is preferably 50 to 250 mm and more preferably 100 to 200 mm. Moreover, the depth of the space of the accommodating body 10 in which space the food is accommodated is preferably 20 to 100 mm and more preferably 30 to 80 mm.

As shown in FIG. 1, the heating cooker 1A includes the mount table 20, on which the single-serving food package 19 is placed, in the heating chamber 2. The mount table 20 includes a flat plate-like ceiling plate 21 and a plurality of leg portions 22 supporting the ceiling plate 21 from below, and thus has a table-like shape. An upper surface of the ceiling plate 21 serves as a mount surface on which the single-serving food package 19 is placed. The mount table 20 is composed of a material (e.g., various synthetic resins) capable of resisting heating in a microwave oven.

As shown in FIG. 1, a leading end of the steam supply pipe 31 of the steam supplier 3 is located under or near the ceiling plate 21 and is hence configured to be able to directly supply steam under the ceiling plate 21. The ceiling plate 21 has steam-permeability, and steam emitted from the steam supply pipe 31 penetrates the ceiling plate 21 in its thickness direction and reaches the single-serving food package 19 placed on the upper surface of the ceiling plate 21. The steam further passes through the plurality of vent holes 15 formed in the bottom surface portion 11 of the accommodating body 10, which is a part of the single-serving food package 19, and reaches the food F in the single-serving food package 19 (accommodating body 10). The arrow in the drawing indicates the flow of steam. The form of the ceiling plate 21 having steam permeability is not limited. For example, the ceiling plate 21 may be a plate of a steam-impermeable material, such as resin, with a plurality of vent holes for steam to pass through which holes are formed in a scattered manner therein and penetrate the plate in the thickness direction. Alternatively, the ceiling plate 21 may be composed of a steam-permeable material (e.g., nonwoven fabric). The vent holes for steam to pass through that are formed in the ceiling plate 21 can be formed in the same manner as the vent holes 15 of the accommodating body 10.

In the heating cooker 1A having the above-described configuration, to heat the food F of the single-serving food package 19 placed in the heating chamber 2, steam at a temperature of 85 to 130° C. is supplied into the heating chamber 2 by the steam supplier 3, and microwaves with an actual output of 500 to 3000 W are supplied for 15 to 180 seconds by the microwave supplier 4 while the steam is supplied into the single-serving food package 19 via the vent holes 15. Supplying steam and microwaves to the food F in the single-serving food package 19 (accommodating body 10) under the above-described conditions makes it possible to sufficiently heat and cook the food F in a short period of time without causing uneven heating and excessive heating and also makes it possible to easily and hygienically obtain high-quality heated and cooked food without making hands dirty. The steam at a temperature less than 85° C., the actual output of microwaves less than 500 W, or the supply time of microwaves less than 15 seconds cause a risk that cooking may take too much time. The steam at a temperature more than 130° C., the actual output of microwaves more than 3000 W, or the supply time of microwaves more than 180 seconds cause a risk that the quality of the food after cooking may deteriorate due to excessive heating. The "actual output of microwaves" as used herein means a rated high-frequency output. The temperature of the steam is preferably 95 to 120° C., the actual output of microwaves is preferably 800 to 2000 W, and the supply time of microwaves is preferably 30 to 100 seconds.

In view of ensuring that the above-described effects are provided more reliably, the amount of steam at a temperature of 85 to 130° C. to be supplied into the single-serving food package 19 (accommodating body 10) is preferably 1 to 100 g and more preferably 30 to 80 g. However, these preferable amounts of steam to be supplied are for cases where vent holes are formed in the bottom surface portion as in the case of the accommodating body 10. In cases where no vent holes are formed in the bottom surface portion as in an accommodating body 10E (see FIG. 6) described later, the amount of steam to be supplied is preferably 1 to 100 g and more preferably 20 to 50 g in view of preventing the disadvantage in that the food in the single-serving food package becomes wet with a liquid (condensation water) exuding from the food on heating and cooking the single-serving food package. The amount of steam to be supplied into the single-serving food package 19 can be adjusted by adapting the shape in plan view and formation pattern of the vent holes 15 of the accommodating body 10 and the conditions of steam supply as appropriate. Specific examples of the approach for adapting the conditions of steam supply include adjusting the amount of water supplied to the steam generator 30, adapting the shape and arrangement of the steam supply pipe 31 with some contrivance, and installing a fan capable of adjusting the flow of steam in the heating chamber 2.

FIGS. 3 to 6 show other embodiments of the food cooking system of the present invention. With respect to the other embodiments described below, while constituent portions that are different from those of the heating cooker 1A of the above-described embodiment will be mainly described, the same constituent portions as those of the heating cooker 1A are denoted by the same reference numerals, and their description is omitted. The same description for the heating cooker 1A is applied as appropriate to those constituent portions that are not specifically described.

Figure 3A:
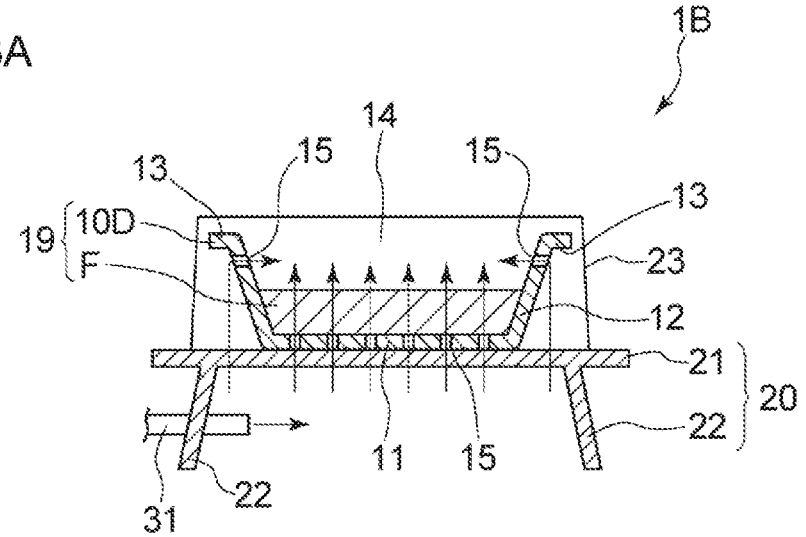
FIG. 3A schematically shows a relevant portion of another example of the heating cooker as the embodiment of the food cooking system of the present invention.
Figure 3B:
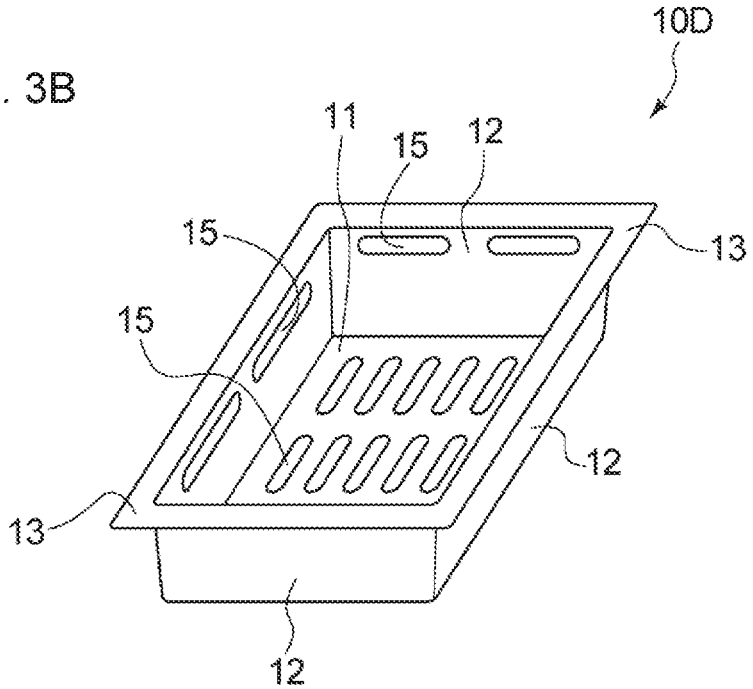
FIG. 3B is a perspective view schematically showing an embodiment of an accommodating body of the heating cooker shown in FIG. 3A.

The above-described heating cooker 1A is configured to supply steam to the food F in the single-serving food package 19 from only below the food F, whereas all of the embodiments shown in FIGS. 3 to 5 are configured to supply steam to the food F in the single-serving food package 19 from both above and below the food F. Supplying steam from both above and below the food reduces the cooking time compared with supplying steam from only one direction, and thus, a further improvement in the quality is expected to be achieved.

A heating cooker 1B shown in FIG. 3 employs an accommodating body 10D in which the vent holes 15 are formed in not only the bottom surface portion 11 but also the peripheral surface portion 12. The accommodating body 10D has the same configuration as the accommodating body 10B shown in FIG. 2B except that the vent holes 15 are formed in the peripheral surface portion 12 and that the accommodating body 10D does not have a lid portion that covers the upper opening 14. The vent holes 15 of the peripheral surface portion 12 are located at positions above the food accommodated in the accommodating body 10D, and function as inlet portions for steam at those positions, in the same manner as the upper opening 14. The vent holes 15 in the peripheral surface portion 12, that is, the vent holes 15 that are located above the accommodated food are formed such that the plurality of vent holes 15 are formed in a scattered manner near an upper end of the peripheral surface portion 12, or more specifically, in a region within 50% of the depth of the accommodating body 10 from the upper end of the peripheral surface portion 12. The vent holes 15 of the peripheral surface portion 12 can be formed in the same manner as the vent holes 15 of the bottom surface portion 11. The vent holes 15 of the peripheral surface portion 12 may have the same shape and dimensions as the vent holes 15 of the bottom surface portion 11 or may have a shape and dimensions different from those of the vent holes 15 of the bottom surface portion 11.

Moreover, since the vent holes 15 are formed in the peripheral surface portion 12 of the accommodating body 10D, the heating cooker 1B includes a package cover 23 that covers the entirety of the single-serving food package 19 placed on the mount table 20 (ceiling plate 21), as shown in FIG. 3A. The package cover 23 is composed of a material (e.g., various synthetic resins) that is steam impermeable and is capable of resisting heating in a microwave oven. Therefore, when the package cover 23 is placed on the upper surface of the ceiling plate 21 of the mount table 20 so as to cover the entirety of the single-serving food package 19, steam permeating the ceiling plate 21 easily fills a space defined by the ceiling plate 21 and the package cover 23, and a part of the steam within this space enters the accommodating body 10D from positions above the food F through the vent holes 15 in the peripheral surface portion 12 and the upper opening 14 of the accommodating body 10D of the single-serving food package 19, and reaches the food F.

As described above, in the heating cooker 1B, the accommodating body 10D has the vent holes 15 in the bottom surface portion 11, on which the food F is placed, and at positions above the food F in the accommodating body 10D; steam is directly supplied under the mount table 20; the supplied steam permeates the mount table 20; a part of the steam that has permeated the mount table 20 is introduced into the single-serving food package 19 (accommodating body 10D) via the vent holes 15 in the bottom surface portion 11; another part of the steam that has permeated the mount table 20 is introduced into the space defined by the mount table 20 and the package cover 23, and further introduced into the single-serving food package 19 via the vent holes 15 (vent holes of the peripheral surface portion 12) at the positions above the food F and the upper opening 14. Thus, steam can be supplied to the food F in the single-serving food package 19 from both above and below the food F. Consequently, with the heating cooker 1B, food can be efficiently heated and cooked, problems such as uneven heating are unlikely to occur, and heated and cooked food with higher quality can be obtained in a relatively short period of time.

In view of balance between the efficiency of heating the food with steam and the functions of the container, with respect to the plurality of vent holes 15 in the peripheral surface portion 12 of the accommodating body 10D (vent holes at the positions above the food in the accommodating body 10D), the length of the longest portion of each vent hole 15 at an opening end portion on the inner surface side of the accommodating body 10D is preferably not more than 50 mm and more preferably 10 to 35 mm. Moreover, from the same standpoint, the opening ratio of the peripheral surface portion 12 is preferably 1 to 50% and more preferably 10 to 35%.

Figure 4A:
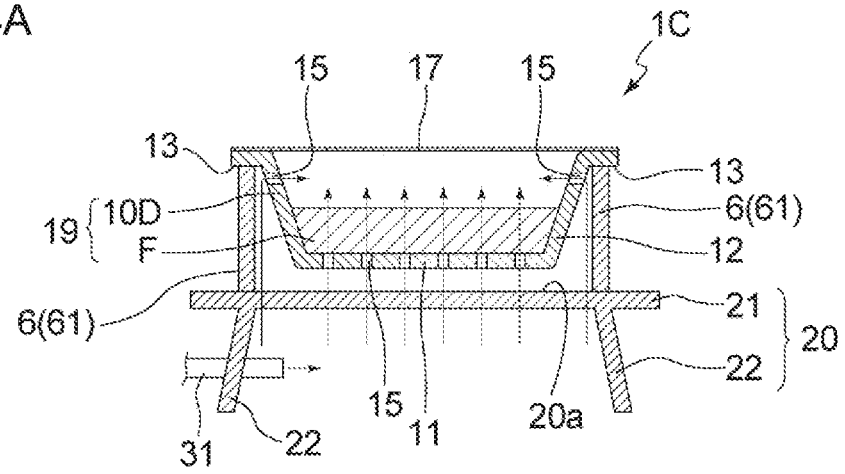
FIG. 4A schematically shows a relevant portion of still another example of the heating cooker as the embodiment of the food cooking system of the present invention.
Figure 4B:
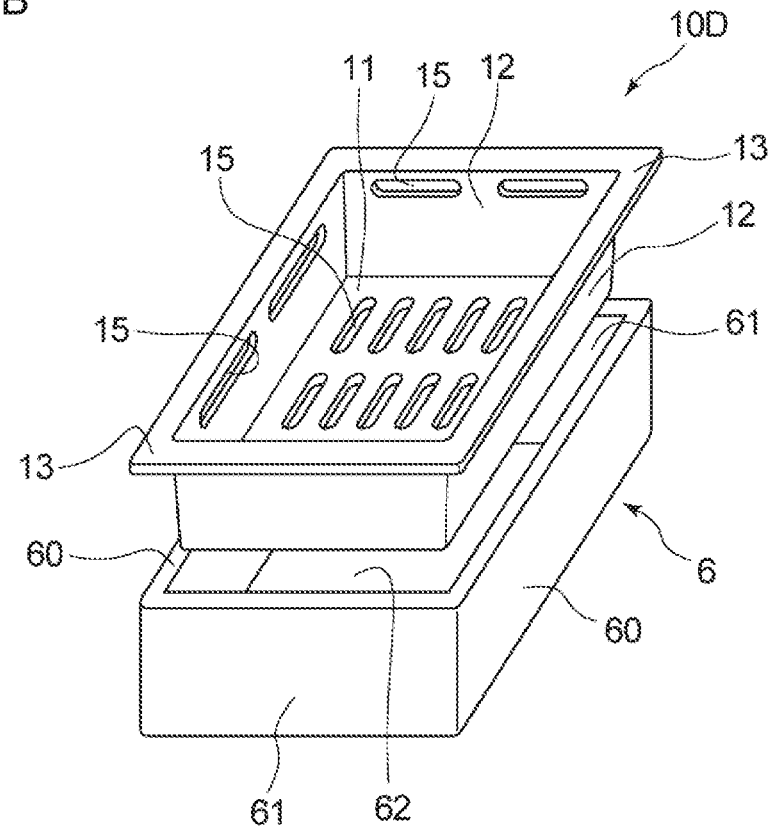
FIG. 4B is a perspective view schematically showing an accommodating body and a support member of the heating cooker shown in FIG. 4A.

A heating cooker 1C shown in FIG. 4 differs from the heating cooker 1B shown in FIG. 3 in that the heating cooker 1C does not include the package cover 23 but instead includes a support member 6. As shown in FIG. 4A, the heating cooker 1C includes the mount table 20 and the support member 6 that is placed on the mount table 20 and supports the single-serving food package 19 so that the single-serving food package 19 remains at a position above the upper surface 20*a* of the mount table 20. The single-serving food package 19 includes the accommodating body 10D. The accommodating body 10D is as described above. As also shown in FIG. 4B, the accommodating body 10D is a resin or paper tray including the bottom surface portion 11 on which the food F is placed and the peripheral surface portion 12 extending upward from the peripheral edge of the bottom surface portion 11, has the vent holes 15 in the bottom surface portion 11 and at positions above the food F in the accommodating body 10D, and has the flange portion 13 that is formed protruding from the upper end portion of the peripheral surface portion 12.

As shown in FIG. 4B, the support member 6 is a frame that can surround the peripheral surface portion 12 of the tray-type accommodating body 10D. The support member 6 is formed of a material (e.g., various synthetic resins) that is steam impermeable and capable of resisting heating in a microwave oven. The support member 6 having the form shown in the figure is constituted by two pairs of opposing plate-like members 60 and 61, that is, a pair of opposing plate-like members 60 that are relatively long in the longitudinal direction and a pair of opposing plate-like members 61 that are relatively short in the longitudinal direction. Also, the support member 6 has an opening 62 that has a rectangular shape in plan view and penetrates the central portion of the support member 6 in the up-down direction. The support member 6 has thus a ring-like shape with the above-described opening 62 being surrounded by the four plate-like members 60 and 61. The opening 62 of the support member 6 is used as an insertion opening for the accommodating body 10D that is used in combination with the support member 6. The shape of the opening 62 in plan view is similar to the shape of the bottom surface portion 11 of the accommodating body 10D in plan view, and the area of the opening 62 is larger than the area of the bottom surface portion 11. Moreover, the shape of the opening 62 in plan view is similar to the shape of the flange portion 13 (outline of the flange portion 13) of the accommodating body 10D, and the area of the opening 62 is smaller than the area of an upper surface portion (lid portion 17) of the accommodating body 10D including the flange portion 13. Note that the bottom surface portion 11, the flange portion 13, and the support member 6 are not necessarily required to have similar shapes in plan view, and may also have different shapes in plan view. Moreover, the height (depth of the opening 62) of the support member 6 is larger than the height of the accommodating body 10D.

As shown in FIG. 4, when the tray-type accommodating body 10D is inserted, from the bottom surface portion 11 side thereof, into the opening 62 of the frame-type support member 6 placed on the mount table 20, a portion of the accommodating body 10D that is located below the flange portion 13 is accommodated in the support member 6, and the flange portion 13 and the lid portion 17 located thereabove are not accommodated in the opening 62 and protrude from the opening 62. Here, when the flange portion 13 of the accommodating body 10D abuts against an upper end of the support member 6, the accommodating body 10D is supported by the support member 6 at a position above the upper surface 20*a* of the mount table 20 as shown in FIG. 4A, since the height of the support member 6 is larger than the height of the accommodating body 10D. As a result, a space is formed between the bottom surface portion 11 of the accommodating body 10D and the ceiling plate 21 of the mount table 20.

In the heating cooker 1C having the above-described configuration, as shown in FIG. 4A, steam is directly supplied under the mount table 20 by the steam supply pipe 31, the supplied steam permeates the mount table 20, a part of the steam that has permeated the mount table 20 is introduced into the single-serving food package 19 (accommodating body 10D) via the vent holes 15 in the bottom surface portion 11, and another part of the steam that has permeated the mount table 20 is introduced into a space defined by the mount table 20, the single-serving food package 19, and the support member 6 and further introduced into the single-serving food package 19 via the vent holes 15 at the positions above the food F. Thus, steam can be supplied to the food F in the single-serving food package 19 from both above and below the food F. Therefore, with the heating cooker 1C, food can be efficiently heated and cooked, problems such as uneven heating are unlikely to occur, and higher-quality heated and cooked food can thus be obtained in a relatively short period of time.

Figure 5A:
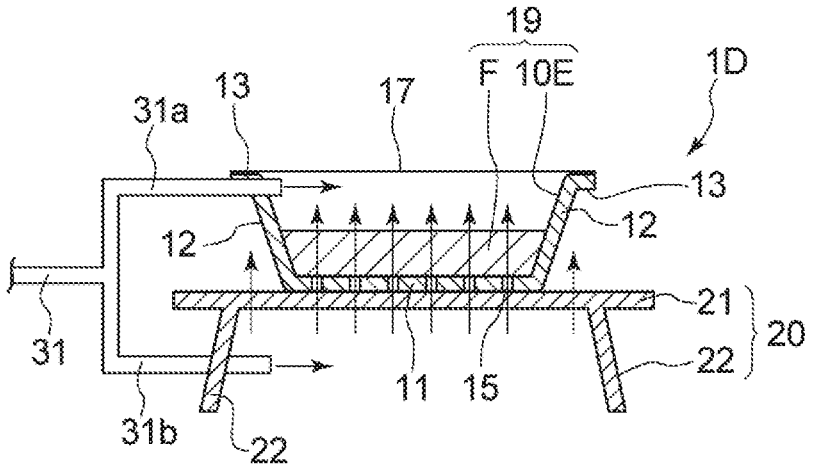
FIG. 5A schematically shows a relevant portion of still another example of the heating cooker as the embodiment of the food cooking system of the present invention.
Figure 5B:
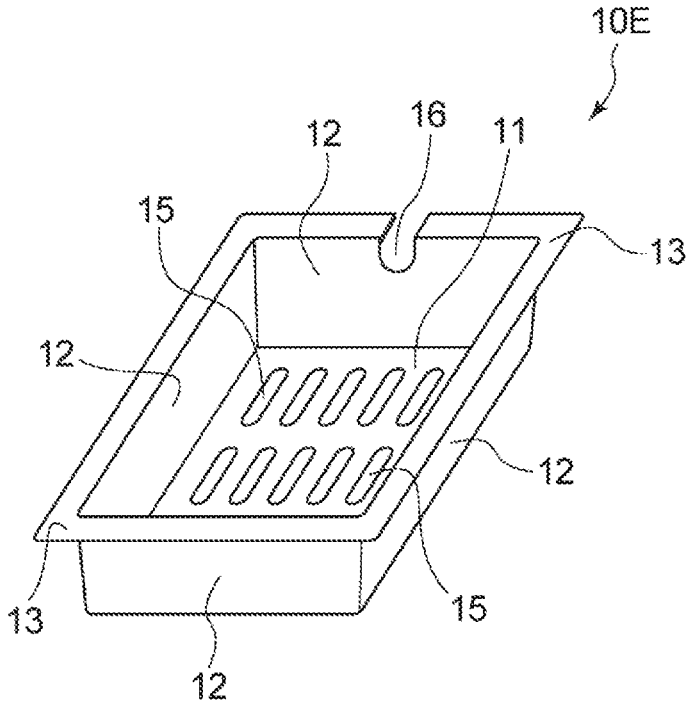
FIG. 5B is a perspective view schematically showing an embodiment of an accommodating body of the heating cooker shown in FIG. 5A.

In a heating cooker 1D shown in FIG. 5, as shown in FIG. 5A, the leading end side (steam-emitting opening side) of the steam supply pipe 31 of the steam supplier 3 is branched into two pipes, that is, an upper supply pipe 31*a* and a lower supply pipe 31*b*. The upper supply pipe 31*a* is connected to the single-serving food package 19 (accommodating body 10E) placed on the mount table 20, while the lower supply pipe 31*b* extends under the ceiling plate 21 of the mount table 20. As shown in FIG. 5B, a steam supply pipe insertion opening 16 into which the upper supply pipe 31*a* can be inserted is formed in the peripheral surface portion 12 of the accommodating body 10E. The steam supply pipe insertion opening 16 is formed in an upper end portion of one of the four plate-like side wall portions constituting the peripheral surface portion 12. As shown in FIG. 5A, the steam supply pipe insertion opening 16 functions as an inlet portion for steam that is located above the food F accommodated in the accommodating body 10E.

In the heating cooker 1D having the above-described configuration, steam is directly supplied under the mount table 20 by the lower supply pipe 31*b*, and steam is directly supplied to the food F in the single-serving food package 19 (accommodating body 10E) on the mount table 20 by the upper supply pipe 31*a* through the steam supply pipe insertion opening 16 that is located above the food F. The steam that has been supplied under the mount table 20 through the lower supply pipe 31*b* permeates the steam-permeable ceiling plate 21 and is further introduced into the single-serving food package 19 via the vent holes 15 in the bottom surface portion 11 of the accommodating body 10E. In the heating cooker 1D, steam can thus be supplied to the food F in the single-serving food package 19 from both above and below the food F. The heating cooker 1D provides the same effects as those of the heating cookers 1B and 1C.

In all of the embodiments shown in FIGS. 3 to 5, the bottom surface portion 11 of the accommodating body 10D or 10E constituting the single-serving food package 19 has the vent holes 15 for steam to pass through. However, the bottom surface portion 11 is not necessarily required to have the vent holes 15. When the vent holes 15 are present in the bottom surface portion 11 of the accommodating body 10D or 10E, there is the advantage of allowing a liquid (condensation water) such as water exuding from the food in the single-serving food package 19 when heated and cooked to be discharged from the vent holes 15 in the bottom surface portion 11. On the other hand, since condensation water is discharged from a bottom portion of the heated and cooked single-serving food package 19, a separate receiving tray for receiving the condensation water is required when eating and serving the heated and cooked single-serving food package 19, and therefore, the ease of handling of the single-serving food package 19 decreases. In the case where no vent holes 15 are provided in the bottom surface portion 11 of the accommodating body, the advantage of preventing such a decrease in handleability is obtained. On the other hand, the problem of discharge of condensation water, which is a concern in the case where no vent holes 15 are provided in the bottom surface portion 11, can be dealt with by adjusting the amount of steam to be supplied into the single-serving food package 19, as described above. Note that, with respect to the embodiments shown in FIGS. 3 to 5, in the case where no vent holes 15 are formed in the bottom surface portion 11, steam in the heating chamber 2 is supplied from only the upper opening 14 or the vent holes 15 that are located at positions above the food in the accommodating body 10D or 10E, and thus, the cooking time reducing effect and the like decreases compared with the case in which, as shown in FIGS. 3 to 5, the vent holes 15 are also provided in the bottom surface portion 11 so that steam can be supplied from both above and below the food.

Figure 6A:
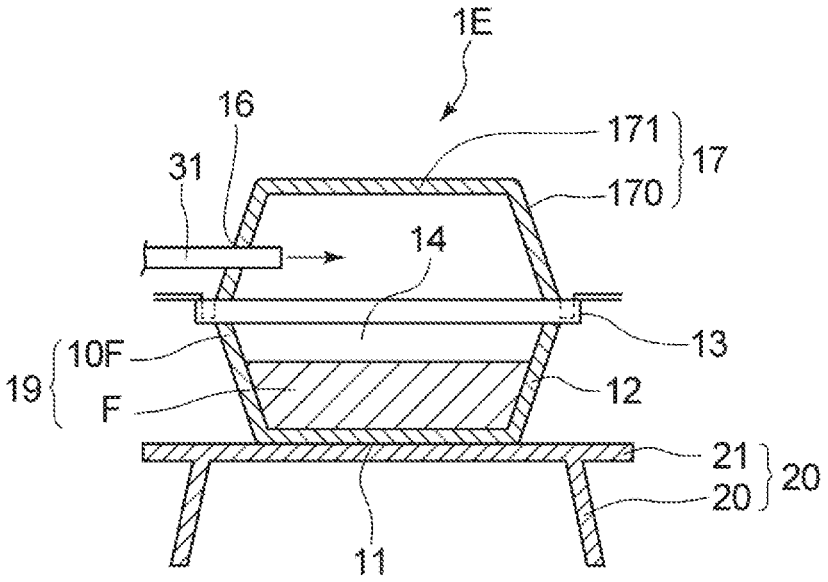
FIGS. 6A and 6B each schematically show a relevant portion of still another example of the heating cooker as the embodiment of the food cooking system of the present invention.

FIG. 6 shows an embodiment in which no vent holes for steam to pass through are provided in the bottom surface portion of the accommodating body. In a heating cooker 1E shown in FIG. 6(*a*), the single-serving food package 19 includes a tray-type accommodating body 10F in which no vent holes are provided and the lid portion 17 that has a three-dimensional shape and covers the upper opening 14 of the accommodating body 10F, and the steam supply pipe 31 is connected to the single-serving food package 19 (accommodating body 10F) via the steam supply pipe insertion opening 16 that is provided in the lid portion 17. The accommodating body 10F has the same configuration as the accommodating body 10D except that no vent holes for steam to pass through are provided, and is configured such that steam can be taken in only through the upper opening 14. In the heating cooker 1E having the above-described configuration, steam is supplied to the food F in the single-serving food package 19 (accommodating body 10F) from only the steam supply pipe 31 (steam supply pipe insertion opening 16) that is located above the food F. The lid portion 17 having a three-dimensional shape has a peripheral surface portion 170 in which the steam supply pipe insertion opening 16 is provided and an upper surface portion 171 that is joined to an upper end portion of the peripheral surface portion 170 and that opposes the bottom surface portion 11 of the accommodating body 10F, and a lower end portion of the peripheral surface portion 170 is configured to be engageable (fittable) with an opening edge portion of the upper opening 14 of the accommodating body 10F.

Figure 6B:
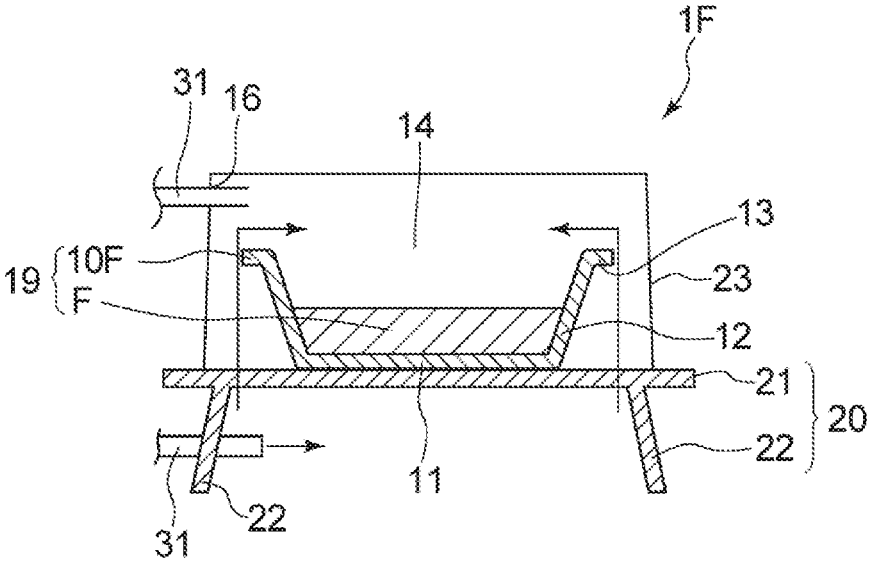

A heating cooker 1F shown in FIG. 6B differs from the heating cooker 1B shown in FIG. 3A in that the accommodating body 10F in which no vent holes are provided is used and that the steam supply pipe 31 is connected via the steam supply pipe insertion opening 16 provided in a package cover 23.

Although the present invention has been described based on the preferred embodiments thereof, the present invention is not limited to the foregoing embodiments. All the portions provided in only one of the foregoing embodiments can be used in the other embodiments. Although the plurality of vent holes of the accommodating body have the same shape and dimensions in the foregoing embodiments, a combination of a plurality of vent holes having different shapes and/or dimensions can also be adopted. Moreover, although the accommodating body constituting the single-serving food package is a tray in the foregoing embodiments, the accommodating body according to the present invention is only required to be able to take steam that is in the heating chamber into the accommodating body (the single-serving food package), and may be, for example, a resin packaging bag for individual packaging of the food. The packaging bag may also be a so-called standing pouch that can stand by itself. In the case where a packaging bag is used as the accommodating body, it is preferable to use the packaging bag together with a member, such as the support member 6 shown in FIG. 4 which can support the packaging bag at a position above the upper surface of the mount table.

The food cooking system of the present invention is applicable to a cooking appliance for heating food with steam and microwaves. For example, the food cooking system can be applied to a microwave oven, a multifunction microwave oven, a defrosting device, and the like. Moreover, the food in the single-serving food package may also include, in addition to a main food dish such as noodles or cooked rice, a supplementary food dish, for example, sauce, ingredients, and toppings, to be eaten with the main food dish.

EXAMPLES

In order to specifically describe the present invention, examples will be given below. However, the present invention is not limited to the following examples.

Example 1

A food cooking system was prepared, the food cooking system being constituted by a combination of a heating cooker having the same configuration as the heating cooker 1A shown in FIG. 1 and a single-serving food package including frozen Chinese dumplings, which were objects to be cooked, and an accommodating body accommodating the frozen Chinese dumplings. The accommodating body of Example 1 was a tray-type polypropylene accommodating body with a lid portion, the accommodating body having the same configuration as the accommodating body 10A shown in FIG. 2A and having a rectangular shape in plan view. Details of the accommodating body were as follows:

Dimensions of space accommodating food (length 100 mm, width 175 mm, depth 35 mm)

Site in which vent holes were formed: bottom surface portion

Vent holes: true circular shape in plan view, opening area 38 $mm^2$, opening ratio of bottom surface portion 15%

Reference Example 1

A food cooking system constituted by a heating cooker having the same basic configuration as the heating cooker disclosed in Patent Literature 3 was prepared. As disclosed in FIG. 1, etc., of Patent Literature 3, the heating cooker disclosed in Patent Literature 3 is configured such that steam can be directly introduced into the container with the lid in which the object to be cooked is accommodated. The internal space of the container is partitioned into two, an upper and lower space, by the steam-permeable partition plate. The object to be cooked is accommodated in the upper space, and steam is directly supplied into the lower space.

Reference Example 2

A food cooking system constituted by a heating cooker having the same basic configuration as the heating cooker disclosed in Patent Literature 4 was prepared. As disclosed in FIGS. 10 to 12 and the like of Patent Literature 4, the heating cooker disclosed in Patent Literature 4 is configured such that steam can be directly introduced into the container with the lid in which the object to be cooked is accommodated, and the container has the receiving tray on which the object to be cooked is placed and the grill tray lid provided with the steam inlet port.

Evaluation Test

Five cooking staff heated and cooked (defrosted) frozen Chinese dumplings by using the food cooking systems of the example and reference examples, and then evaluated the degree of hygiene of handling in a series of operations at that time, on a scale of one to five.

Moreover, as an evaluation index of the ease of the series of operations, working time was measured by using a method described below. The shorter the working time, the easier the handling of the food cooking system, and accordingly, the higher the evaluation. As a result, the working time was 22 seconds in Example 1, 73 seconds in Reference Example 1, and 95 seconds in Reference Example 2.

Measurement of Working Time

With respect to the food cooking system of Example 1, since the frozen Chinese dumplings were contained in the single-serving food package, which was a part of the system, the single-serving food package was stored in a freezer beforehand, and the time (working time) taken to heat, cook, and serve the Chinese dumplings after the time point at which the single-serving food package was taken out of the freezer was measured.

With respect to each of the food cooking systems of Reference Examples 1 and 2, frozen Chinese dumplings packaged in a pillow bag were prepared separately from the system and stored in a freezer beforehand, and the time (working time) taken to heat, cook, and serve the Chinese dumplings after the time point at which the pillow bag was taken out of the freezer was measured. With respect to each of the food cooking systems of Reference Examples 1 and 2, after the pillow bag was taken out of the freezer, the pillow bag was opened, the frozen Chinese dumplings were put in the container with the lid, which was a part of the system, by using a pair of tongs, furthermore, the container was set in the heating chamber of the heating cooker, and thereafter, heating and cooking were performed.

Note that since the present evaluation test was performed mainly to evaluate the ease and degree of hygiene of handling of the food cooking system, cooking conditions were set such that the frozen Chinese dumplings were sufficiently heated in all of the example and reference examples. Therefore, the temperature of the steam and the supply conditions for the microwaves varied among the example and reference examples. For this reason, with regard to the working time, the time obtained by subtracting the time taken for heating from the actually measured time was used as the working time, and an average value of the values of working time for the five respective cooking staff was calculated.

In Example 1, heating and cooking were performed by supplying steam at a temperature of 98° C. into the heating chamber in which the single-serving food package was accommodated, and supplying microwaves with an actual output of 1000 W for 40 second through the microwave supplier while the steam was supplied into the single-serving food package via the vent holes in the bottom surface portion of the accommodating body.

In Reference Example 1, heating and cooking were performed by putting the frozen Chinese dumplings taken out of the pillow bag in the upper space inside the container, and supplying microwaves with an actual output of 1000 W for 40 seconds while directly introducing steam at a temperature of 98° C. into the lower space.

In Reference Example 2, heating and cooking were performed by placing the frozen Chinese dumplings taken out of the pillow bag on the receiving tray constituting the container, and supplying microwaves with an actual output of 1000 W for 180 seconds while directly introducing steam at a temperature of 98° C. into the container from the grill tray lid side of the container.

The evaluation score (average of scores rated by the five graders) of the degree of hygiene of handling was 5.0 points in Example 1, whereas it was 3.5 points in Reference Example 1, and 2.2 points in Reference Example 2. Moreover, with respect to Reference Examples 1 and 2, the following facts were observed in the series of operations. From these observation results as well, it was suggested that the food cooking systems of Reference Examples 1 and 2 had room for improvement in handling and the degree of hygiene of handling.

Reference Example 1

When taking the frozen Chinese dumplings out of the pillow bag, one member of the staff brought the tongs into contact with the outside of the bag.

Two staff brought the tongs into contact with the container.

Reference Example 2

When taking the frozen Chinese dumplings out of the pillow bag, one member of the staff brought the tongs into contact with the outside of the bag.

When removing the lid from the container, one member of the staff brought the tongs into contact with the container.

One member of the staff dropped a heated and cooked Chinese dumpling onto the floor.

It is therefore intended that the foregoing detailed description be regarded as illustrative rather than limiting, and that it be understood that it is the following claims, including all equivalents, that are intended to define the spirit and scope of this invention.

The invention claimed is:

1. A food cooking system comprising:

a single-serving food package including food as an object to be cooked and an accommodating body accommodating the food;

a heating chamber accommodating the single-serving food package;

a steam supplier that supplies steam into the heating chamber;

a microwave supplier that supplies microwaves into the heating chamber;

the food cooking system heating and cooking the food with the steam and the microwaves;

wherein the accommodating body is configured to be able to take in steam that is in the heating chamber into the single-serving food package, and the steam is supplied to the food in the single-serving food package from both above and below the food;

a steam-permeable mount table for the single-serving food package;

a support member that is placed on the steam-permeable mount table and supports the single-serving food package such that the single-serving food package remains at a position above an upper surface of the steam-permeable mount table; and wherein:

the accommodating body is a resin or paper tray including a bottom surface portion on which the food is placed and a peripheral surface portion extending upward from a peripheral edge of the bottom surface portion, has vent holes for steam to pass through in the bottom surface portion and at positions above the food in the accommodating body, and has a flange portion that is formed so as to protrude from an upper end portion of the peripheral surface portion, the support member is a frame that can surround the peripheral surface portion of the tray, and is configured to be able to support the tray at a position above the upper surface of the steam-permeable mount table with the flange portion of the tray abutting against an upper end of the frame placed on the steam-permeable mount table, the steam is directly supplied under the steam-permeable mount table; the supplied steam permeates the steam-permeable mount table; a part of the steam that has permeated the steam-permeable mount table is introduced into the single-serving food package via the vent holes in the bottom surface portion; and another part of the steam that has permeated the steam-permeable mount table is introduced into a space defined by the steam-permeable mount table, the single-serving food package, and the support member and further introduced into the single-serving food package via the vent holes at the positions above the food, and the steam at a temperature of 85 to 130° C. is supplied into the heating chamber by the steam supplier, and microwaves with an actual output of 500 to 3000 W are supplied by the microwave supplier for 15 to 180 seconds while the steam is supplied into the single-serving food package.

2. The food cooking system according to claim 1, wherein the vent holes have an opening area of 6 to 80 $mm^2$, and the bottom surface portion has an opening ratio of 1 to 40%.

3. The food cooking system according to claim 1, wherein:

the steam-permeable mount table on which the single-serving food package is placed, in the heating chamber; and the steam is directly supplied under the steam-permeable mount table, and the steam is directly supplied to the food in the single-serving food package on the steam-permeable mount table from a position above the food.

* * * * *